United States Patent [19]

Krasovsky et al.

[11] 4,372,687

[45] Feb. 8, 1983

[54] INSTANTANEOUS CALENDER DEVICE WITH SPRING AND TAPPET MOUNTED ON ROTARY SHIFTER

[76] Inventors: Boris P. Krasovsky, ulitsa Shkolnaya, 12, kv. 54, Krasnogorsk Moskovskoi oblasti; Vladimir V. Melnik, ulitsa Junykh Lenintsev, 79, korpus 1, kv. 54; Daniel D. Malkin, ulitsa Junykh Lenintsev, 95/13, korpus 1, kv. 31, both of Moscow, all of U.S.S.R.

[21] Appl. No.: 195,198

[22] PCT Filed: Jun. 15, 1979

[86] PCT No.: PCT/SU79/00036

§ 371 Date: Feb. 23, 1980

§ 102(e) Date: Feb. 22, 1980

[87] PCT Pub. No.: WO80/00197

PCT Pub. Date: Feb. 7, 1980

[30] Foreign Application Priority Data

Jun. 23, 1978 [SU] U.S.S.R. ..... 2633720

[51] Int. Cl.[3] ..... G04B 19/24

[52] U.S. Cl. ..... 368/28; 368/37; 368/77; 368/221

[58] Field of Search ..... 368/28, 37, 38, 77, 368/220, 221, 233, 234

[56] References Cited

U.S. PATENT DOCUMENTS

| | | | |
|---|---|---|---|
| 3,186,159 | 6/1965 | Schneiter | 368/38 |
| 3,667,211 | 6/1972 | Schneider | 368/38 |
| 3,673,789 | 7/1972 | Tsuzuki et al. | 368/37 |
| 3,721,085 | 3/1973 | Zaugg | 368/28 |
| 3,875,739 | 4/1975 | Mougin | 368/38 |
| 3,911,667 | 10/1975 | Komiyama | 368/38 |
| 4,142,109 | 1/1980 | Teramoto | 368/37 |
| 4,240,249 | 12/1980 | Malkin et al. | 368/28 |

FOREIGN PATENT DOCUMENTS

| | | | |
|---|---|---|---|
| 2438390 | 2/1975 | Fed. Rep. of Germany | 368/38 |
| 512097 | of 0000 | Switzerland . | |
| 512765 | of 0000 | Switzerland . | |
| 353683 | 5/1961 | Switzerland | 368/37 |
| 245669 | of 0000 | U.S.S.R. . | |

*Primary Examiner*—Bernard Roskoski

*Attorney, Agent, or Firm*—Lilling & Greenspan

[57] ABSTRACT

An instantaneous calendar device is disclosed.

The instantaneous calendar device comprises a stationary part, for example, a bridge, a date ring, a day disk, a rotary shifter, and an actuator. The rotary shifter operates the date ring and the day disk. The actuator is composed of a spring, a tappet, and a calendar wheel coaxial with a cam. The cam of the actuator is rigidly secured to the stationary part of the device, whereas the tappet and the spring are mounted on the rotary shifter.

1 Claim, 2 Drawing Figures

INSTANTANEOUS CALENDER DEVICE WITH SPRING AND TAPPET MOUNTED ON ROTARY SHIFTER

FIELD OF THE INVENTION

The invention relates to timepieces, more specifically to small wrist watches, and has particular reference to instantaneous calendar devices used therein.

DESCRIPTION OF THE PRIOR ART

Well known in the art are instantaneous timepiece calendar devices comprising an actuator composed of a spring, a tappet, and a calendar wheel mounted coaxially with a cam, a rotary shifter operating a date ring and a day disk, and stops. When the calendar wheel rotates, its spoke engages a pin provided on the cam, which is rotatably mounted on the axle of the calendar wheel, whereby the cam is rotated. The cam is connected with the rotary shifter which has projections arranged to engage the teeth of the date ring and of the day disk. The tappet is mounted on the watch plate. One of the tappet arms rides on the cam, thereby winding the spring which is also mounted on the plate. The actuator accumulates energy required for rapidly shifting the date ring and the day disk once in 24 hours. The shifting of the date ring and the day disk is effected by the shifter when the tappet leaves the cam peak.

However, due to the above described arrangement of the tappet, spring and cam in the calendar device, the actuator occupies a considerable area of the watch plate. This disadvantage is a hindrance to employing such a calendar device in small wrist timepieces, for example, in lady's watches.

Also known in the art is an instantaneous timepiece calendar device wherein the tappet is made as a cut spring one end of which is rigidly secured to the watch plate, whereas the other end rides on the side surface of the cam. The day disk is shifted by the cam pin which operates the disk through an intermediate star wheel.

With this constructional arrangement, the actuator suffers from the disadvantage that it occupies a considerable area and adds to frictional losses of energy due to the use of the intermediate star wheel for transmitting rotation from the cam to the day disk. A further disadvantage is that the device under consideration is poorly suited for manufacture since the tappet made in the form of a cut spring necessitates extra time and labor for adjusting the calendar mechanism and excludes the possibility of using a spring band, which possesses higher stability of force characteristics and is conventionally employed in actuators.

Referring to USSR Inventor's Certificate 245669, class G 04B19/24 published in 1969, the instantaneous calendar device disclosed therein comprises a cam-type actuator, two shifting elements, one for a date ring and the other for a day disk, and stops.

The shifting elements are each made in the form of two pins located on the face of a wheel and passing through a slot in a coaxial intermediate wheel which meshes with one of the watch train wheels.

This calendar device suffers from the disadvantage that, due to the design of the shifting mechanism, additional adjustments are required in assembling the device.

SUMMARY OF THE INVENTION

It is an object of the present invention to provide an instantaneous calendar device with the actuator thereof designed so as to enable decreasing the dimensions of the calendar device and thereby to facilitate incorporation thereof in small lady's wrist watches.

The invention provides an instantaneous calendar device comprising an actuator composed of a spring, a tappet and a calendar wheel coaxial with a cam, a rotary shifter operating a date ring and a day disk, and stops.

According to the invention, the actuator cam is rigidly secured to the stationary part of the calendar device, whereas the tappet and the spring are mounted on the rotary shifter.

Owing to the design wherein the cam is rigidly secured to the stationary part, whereas the tappet and the spring are mounted on the rotary shifter, the major elements of the device are interconnected in a novel manner so that they occupy substantially less area than in the devices of the prior art, said area being equal to the projection of the calendar wheel onto the watch plate, and can be arranged without increasing the height of the calendar mechanism, due to which the calendar device of the present invention can be incorporated in lady's wrist watches within the restrictions set by their size.

BRIEF DESCRIPTION OF THE DRAWINGS

The invention will now be more particularly described by way of example with reference to the accompanying drawings, wherein.

DETAILED DESCRIPTION OF THE INVENTION

Figure 2:
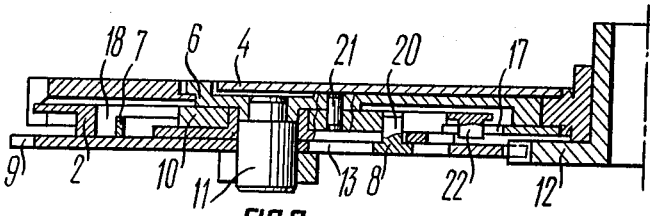
FIG. 2 is a sectional view on the line II—II of FIG. 1.
Figure 1:
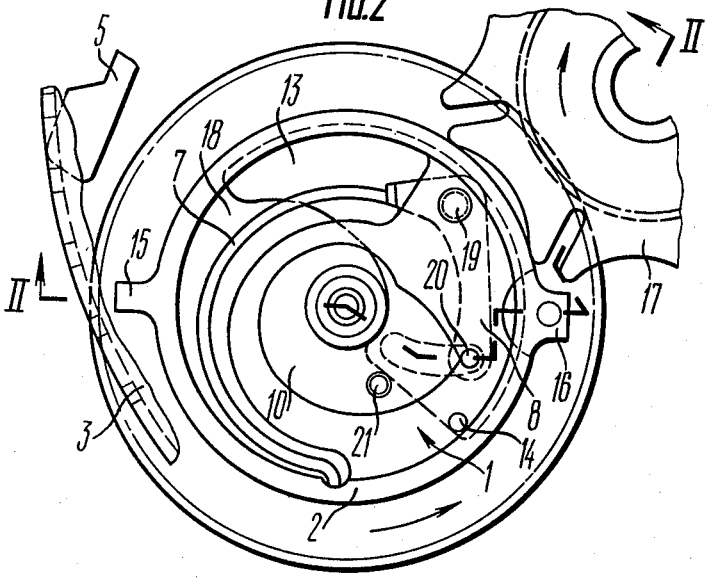
FIG. 1 is a fragmentary diagrammatic top view of the calendar device according to the invention.

The instantaneous calendar device comprises an actuator 1 (FIG. 1), a rotary shifter 2, a date ring 3, a day disk 4 (FIG. 2), a stop 5 (FIG. 1), and stationary parts of the calendar device, for example, a plate (not shown) and a bridge 6 (FIG. 2).

The actuator 2 (FIG. 1) is composed of a spring 7, a tappet 8 made in the form of an L-shaped double-arm lever, a calendar wheel 9, and a cam 10.

Installed in the bridge 6 (FIG. 2) is an axle 11 on which is freely mounted the calendar wheel 9 meshing with an hour wheel 12. The body of the calendar wheel 9 has an opening 13 which receives a pin 14 (FIG. 1) installed in the shifter 2. The shifter 2 has projections 15 and 16 designed to engage once in 24 hours with the date ring 3 and the star wheel 17 of the day disk 4, which star wheel is fashioned as a Maltese cross and is installed coaxially with the hour wheel 12.

The tappet 8 and the spring 7 are mounted on the rotary shifter 2, the spring 7 being installed in an arc-shaped recess 18 formed in the body of the shifter 2. One end of the spring 7 fits into the end of the recess 18, the other end of the spring 7 is articulated to one of the arms of the tappet 8.

The tappet 8 is situated in the opening 13 provided in the calendar wheel 9 and is freely mounted on an axle 19 secured in the body of the shifter 2. The free arm of the tappet 8 has a projection 20 (FIG. 2) interacting with the cam 10 which is mounted coaxially with the calendar wheel 9 and is rigidly secured by means of a pin 21 to the stationary part of the calendar device, for example, the bridge 6 or the plate (not shown).

The stop 5 of the date ring 3 is installed on the stationary part of the calendar device. The function of the stop for the star wheel 17 of the day disk 4 is fulfilled by the outer surface of the shifter 2 which engages with the teeth of the star wheel 17.

Apart from the aforesaid parts constituting the calendar device, use is made of conventional interacting parts designed to provide for the functioning of the calendar device both in automatic operation and in manual correction.

The calendar device operates as follows;

The hour wheel 12 rotates the calendar wheel 9 which, in turn, rotates the shifter 2 by means of the pin 14. The slow rotation of the shifter 2 is transmitted to the tappet 8 mounted on the axle 19.

The projection 20 of the tappet 8 is held against the lobe of the cam 10 and rides thereon, loading the spring 7 which thereby accumulates energy.

When the projection 20 of the tappet 8 reaches the peak of the cam 10 and the spring 7 is compressed to a maximum, the abrupt slope of the cam 10 permits the spring 7 to sharply turn the shifter 2. Now the projection 15 of the shifter 2 engages the groove in the date ring 3 and turns the date ring by one tooth. At the same time the pin 22 secured in the projection 16 of the shifter 2 enters the nearest groove in the star wheel 17 of the day disk 4, turning it through 1/7th of a revolution.

Thereafter the cycle is repeated.

FIELD OF APPLICATION

The instantaneous calendar device is to be used in small wrist watches.

What is claimed is:

1. An improved instantaneous calendar device comprising a date ring; a day disk with a star wheel; a rotary shifter with pins interacting with said date ring and said star wheel of said day disk to rotate said date ring and said day disk at appropriate intervals; stops retaining said date ring and said star wheel of said day disk in position after being rotated by said pins of said rotary shifter; and an actuator including a spring, a tappet, a calendar wheel and a cam having an abrupt slope, said rotary shifter being connected to said calendar wheel for rotation by said calendar wheel, said spring and said tappet being mounted on said rotary shifter and said cam being mounted on a stationary portion of said calendar device, and means for coiling said spring as said rotary shifter rotates and said spring being uncoiled when said tappet contacts the abrupt slope of said cam to cause sharp rotation of the rotary shifter and interaction of the pins of the rotary shifter with the date ring and the star wheel of the day disk.

* * * * *